United States Patent [19]

Szczesniak et al.

[11] Patent Number: 4,936,474

[45] Date of Patent: Jun. 26, 1990

[54] CONTAINER NECK FINISH CONFIGURATION FOR IMPROVED TAMPER EVIDENT BAND BREAKAGE UPON REMOVAL OF ASSOCIATED CLOSURE

[75] Inventors: Dennis A. Szczesniak, Palos Hills; Peter A. Vercillo, Hinsdale, both of Ill.

[73] Assignee: Continental White Cap, Inc., Norwalk, Conn.

[21] Appl. No.: 314,959

[22] Filed: Feb. 24, 1989

[51] Int. Cl.[5] ..... B65D 55/02

[52] U.S. Cl. ..... 215/252; 215/256; 215/258; 215/330

[58] Field of Search ..... 215/250, 252, 258, 330, 215/331, 335, 336, 337

[56] References Cited

U.S. PATENT DOCUMENTS

| | | | |
|---|---|---|---|
| 3,817,416 | 6/1974 | Costa | 215/256 X |
| 3,871,545 | 3/1975 | Bereziat | 215/330 X |
| 3,901,403 | 8/1975 | Menke | 215/258 X |
| 3,924,769 | 12/1975 | Fillmore | 215/330 X |
| 3,955,696 | 5/1976 | Finke | 215/258 X |
| 4,310,101 | 1/1982 | Sekine | 215/330 |
| 4,494,664 | 1/1985 | Guala | 215/252 |
| 4,527,706 | 7/1985 | Swartzbaugh et al. | 215/252 |
| 4,771,904 | 9/1988 | Perne et al. | 215/258 X |

FOREIGN PATENT DOCUMENTS

| | | | |
|---|---|---|---|
| 37488 | 7/1973 | Australia | 215/252 |
| 1371041 | 7/1964 | France | 215/252 |
| 1438648 | 6/1976 | United Kingdom | 215/252 |

OTHER PUBLICATIONS

*"The P-3 Closure", Aluminum Company of America product brochure-form #992-100-6033, 1 page.*

*Primary Examiner*—Stephen Marcus
*Assistant Examiner*—Christine A. Peterson
*Attorney, Agent, or Firm*—Charles E. Brown; Paul Shapiro; Charles A. Brown

[57] ABSTRACT

This relates to an improved container tamper evident bead and neck finish arrangement which provides improved tamper evident band breakage upon removal of an associated closure. Most specifically, beneath the customary retaining bead, a container neck finish is of corrugated or scalloped configuration and is of a size whereby the tamper evident band or a retaining bead thereof is stretched across the space defined by a groove between two adjacent ribs so as to provide for a degree of interlock between the stretched tamper band and the container neck finish such that the tamper evident band is restrained against rotation with the remainder of the closure when the closure is rotated to effect removal thereof. This provides for a much quicker and more reliable breaking of the webs joining the tamper evident band to the closure skirt.

14 Claims, 3 Drawing Sheets

CONTAINER NECK FINISH CONFIGURATION FOR IMPROVED TAMPER EVIDENT BAND BREAKAGE UPON REMOVAL OF ASSOCIATED CLOSURE

This invention relates in general to new and useful improvements in container neck finish configurations, and more particularly to a neck finish configuration which will provide an interlock with a closure tamper evident band so as to prevent rotation of the tamper band when the closure is rotated during the removal thereof thereby effecting an early breakage of the tamper band from the closure.

Many tamper evident closures utilize a break away band which is attached to the bottom of the skirt of the closure by means of frangible webs. When a closure of this type is being removed from a container neck finish, the retaining bead of the closure tamper band engages a retaining bead of the neck finish. As the closure continues to be removed, the interference between the two retaining beads restrict any further axial movement of the tamper band relative to the neck finish. Thus, further movement of the closure axially fractures the webs thus indicating that the closure has been removed.

As stated above, once the two retaining beads engage one another upon closure removal initiation, no further axial movement by the closure tamper band takes place. However, the tamper band still may rotate with the closure until the closure has risen far enough to fracture the frangible webs. To help improve tamper band breakage so that a quicker and more reliable separation of the tamper band from the closure is obtained, the neck finish of the container is modified in accordance with this invention.

Most particularly, beneath the usual retaining bead on the neck finish, that portion of the neck finish is generally of a corrugated construction to include circumferentially spaced axial ribs. The retaining bead of the tamper band is of a lesser diameter than the outline of the corrugated outline portion so as to be stretched between adjacent ribs and thus form an interlock between the tamper band restraining bead and the neck finish. This provides for an interlock or interference between the tamper band retaining bead and the neck finish so as to resist the rotation of the tamper band with the closure when the closure is rotated to effect removal thereof.

In accordance with this invention it is also proposed to downwardly taper the corrugated outline portion of the neck finish so that once the tamper band is removed from an associated closure, it will slide down on the neck finish to most specifically indicate closure movement towards a container open position.

With the above and other objects in view that will hereinafter appear, the nature of the invention will be more clearly understood by reference to the following detailed description, the appended claims, and the several views illustrated in the accompanying drawings.

Figure 1:
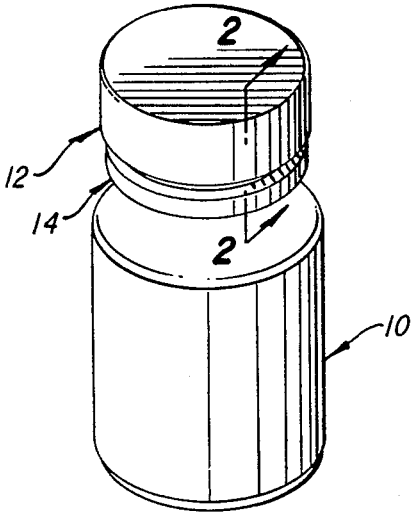
FIG. 1 is a perspective view of a container closed by a closure having a tamper evident band with the container being provided with the neck finish in accordance with this invention.

Referring now to the drawings in detail, it will be seen that there is illustrated in FIG. 1 a conventional type of container 10 which is, as will hereinafter be described, modified in accordance with this invention. The container 10 is closed by a closure 12 having a tamper evident band 14.

Figure 2:
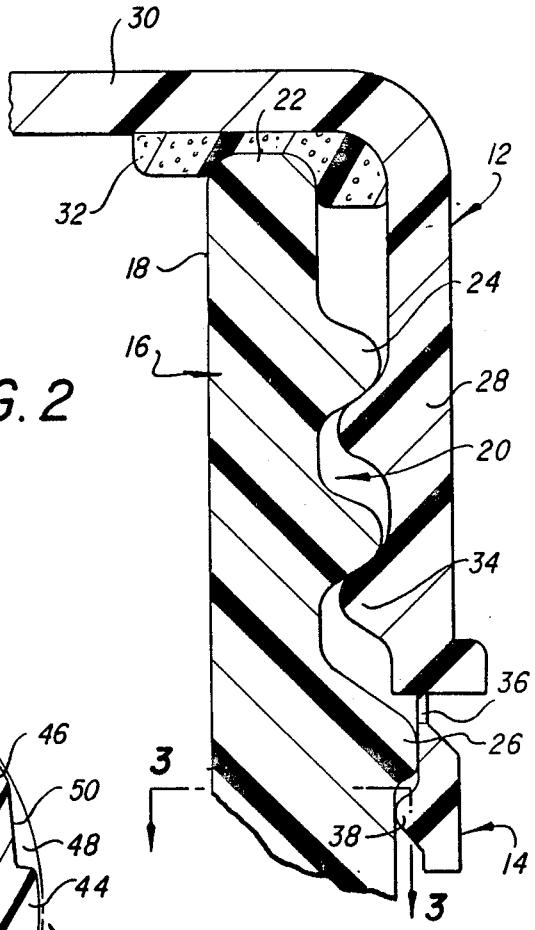
FIG. 2 is an enlarged fragmentary vertical sectional view taken generally along the line of 2—2 of FIG. 1 and shows specifically the relationship between the closure and the container neck finish.

Referring now to FIG. 2, it will be seen that the container 10 includes a neck portion generally identified by the numeral 16 and internally defining a throat 18. The neck portion 16 is provided with a neck finish generally identified by the numeral 20.

The extreme end of the neck portion 16 is in the form of an end sealing surface 22.

The neck finish 20, below the end sealing surface 22, is provided with closure retaining means which are preferably in the form of external threads 24.

Spaced axially of the threads 24 remote from the end sealing surface 22, the neck finish 20 includes a tamper evident band retaining bead 26.

The closure 12 is of a conventional type and is preferably in the form of an injection molded plastic closure including a generally cylindrical skirt 28 having an integral end panel 30. The end panel 30 carries a sealing gasket ring 32 which is engageable with the end sealing surface 22 to assure a sealed closing of the container 10.

The skirt 28 is internally provided with threads 34 which interlock with the threads 24 to retain the closure 12 on the neck finish 20 for removal of the closure by rotating the same.

The tamper evident band 14 is secured to the lower edge of the skirt 28 by a plurality of circumferentially spaced breakable webs 36 and is provided with a radially inwardly projecting retaining bead 38.

When the closure 12 is applied to the container 10, it is normally applied by snapping the retaining bead 38 down over the retaining bead 26. As a result, the retaining bead 38 is normally spaced below the retaining bead 36. Thus when the closure 12 is to be removed, it must move upwardly on the container neck 16 a certain distance before the bead 38 engages the bead 36 and prevents further upward or axial movement of the tamper band 14. Then further removal of the closure 12 will result in the breaking of the webs 36 and the release of the tamper band 14.

Figure 3:
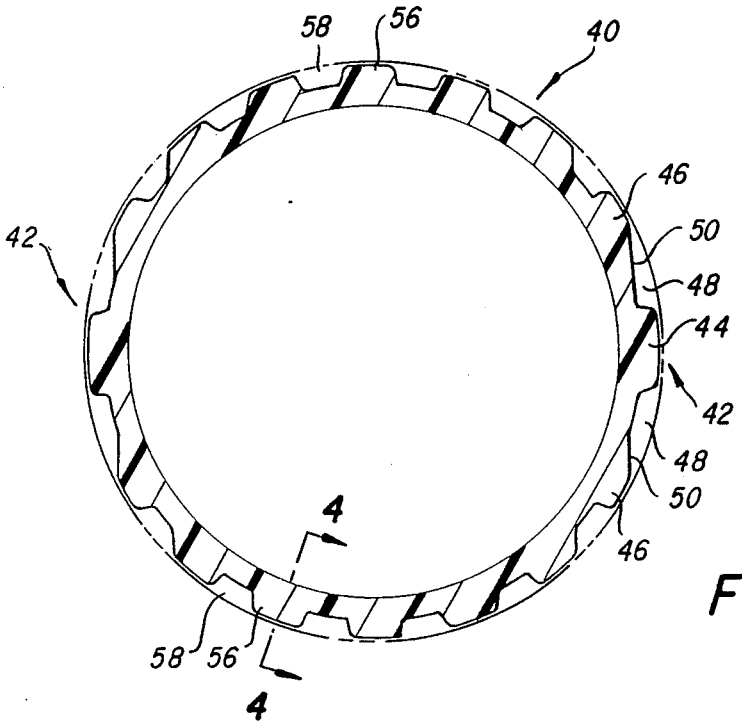
FIG. 3 is a horizontal sectional view taken through the container neck finish generally along the line 3—3 of FIG. 2 and shows the corrugated configuration thereof.
Figure 6:
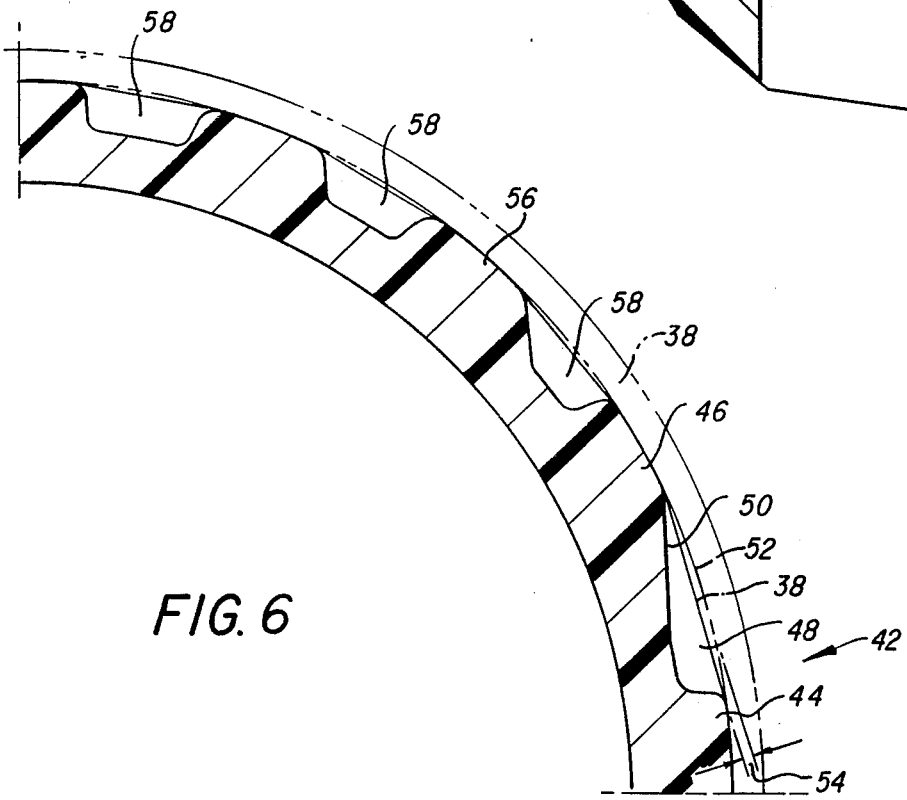
FIG. 6 is an enlarged fragmentary sectional view showing a portion only of FIG. 3 and more specifically showing the configuration of the corrugated outline.

In accordance with this invention, the neck finish 20 below the retaining bead 26 is of a modified construction, most particularly so as to be of a corrugated outline as is clearly shown in FIG. 3. This corrugated outline neck finish portion is identified by the numeral 40 and, as is best shown in FIGS. 3 and 6, include diametrically oppositely facing rib portions generally identified by the numeral 42. Each rib portion 42 includes a centrally located principal rib 44 and a pair of circumferentially spaced secondary ribs 46 which are separated by grooves 48. Each rib 46 has a relatively flat face 50. It is to be noted that each rib 48 is of a relatively great circumferential width and that the retaining bead 38, when tensioned across the space between the adjacent beads 44, 46 will assume a generally straight line condition which is offset relative to the usual arcuate state 52 by a distance 54. Because of this flattened tensioned configuration in alignment with each of the grooves 48, there is a certain degree of interlock between the retaining bead 38 and the neck finish portion 40 which prevents rotation of the tamper evident band 14 with the closure 12 when the closure is rotated in a closure removing operation. Thus the webs 36 are subjected to an early torsional force which will result in an early rupture of the webs in torsion as opposed to rupture of the webs in tension as normally occurs.

It is also be to be noted that the corrugated outline neck finish portion 40 between the portions 42 is of a generally corrugated configuration and includes a plurality of ribs 56 which are separated from one another and from the ribs 46 by grooves 58. The retaining bead 38 is also tensioned across the grooves 58 to provide a separate interlock with the neck finish portion 40 which resists rotation of the tamper evident band 14 with the closure 12.

Figure 4:
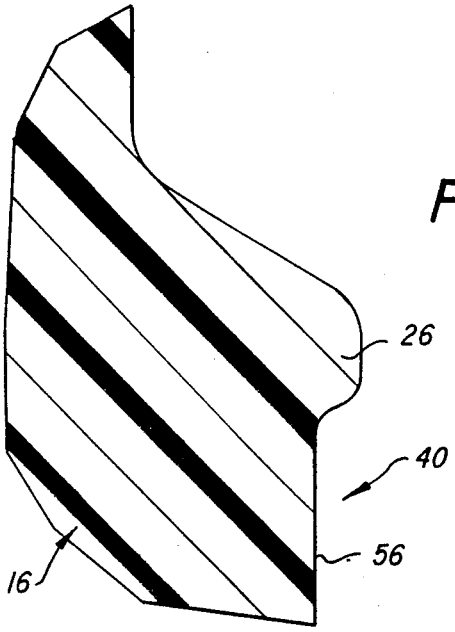
FIG. 4 is an enlarged fragmentary vertical sectional view taken generally along the line 4—4 of FIG. 3 and shows the specific configuration of the neck finish in the tamper band restraining area taken through one of the ribs of the corrugated outline.
Figure 5:
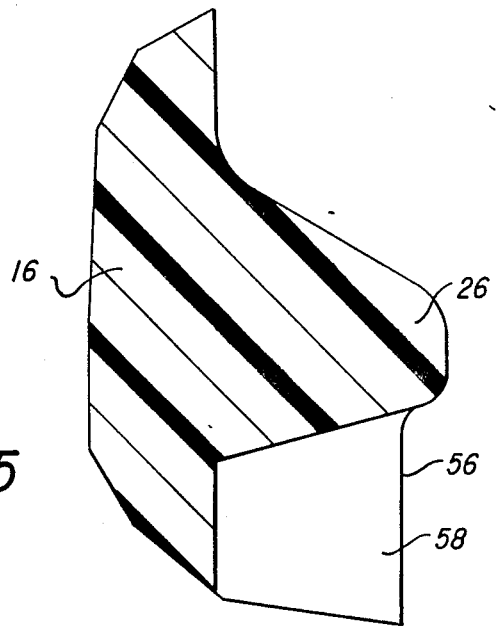
FIG. 5 is an enlarged fragmentary vertical sectional view similar to FIG. 4 but taken through the corrugated outline portion of the neck finish between ribs.
Figure 7:
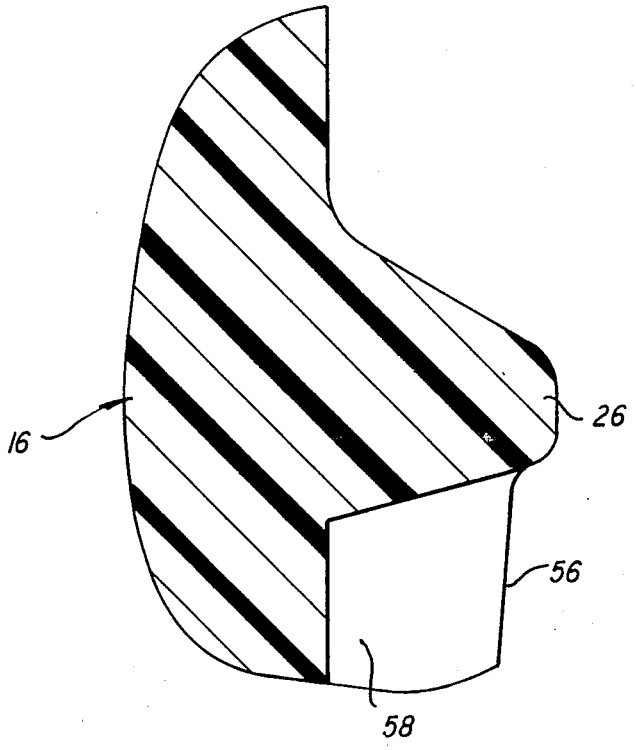
FIG. 7 is an enlarged fragmentary vertical sectional view similar to FIG. 4 but wherein the corrugated outline portion of the neck finish is tapered axially.
Figure 8:
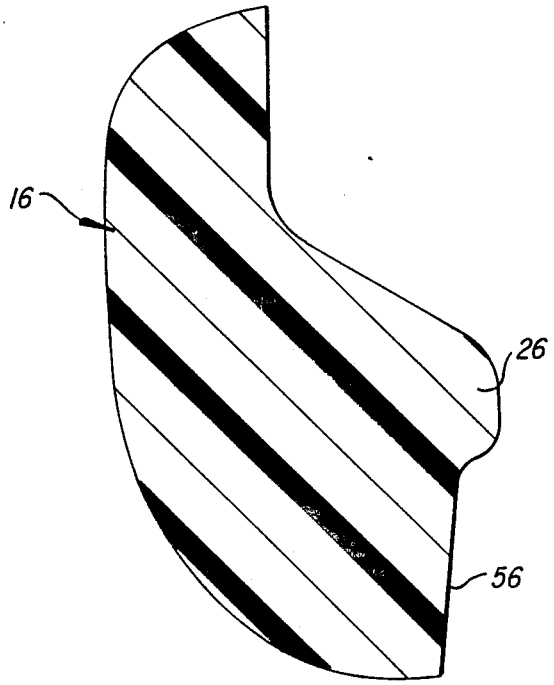
FIG. 8 is an enlarged fragmentary vertical sectional view similar to FIG. 7 but corresponding to FIG. 5.

Referring now to FIGS. 4 and 5, it will be seen that in elevation each of the ribs 56 is of a constant radial dimension as is the base of each of the grooves 58. On the other hand, with reference to FIGS. 7 and 8, it will be seen that in a modified form of the invention, each of the ribs 56 and each of the grooves 58 is of a downwardly tapering configuration in elevation. When the corrugated outline neck finish portion 40 is tapered as shown in FIGS. 7 and 8, once the tamper evident band 14 has been broken off from the closure skirt, the band has a tendency to drop down so as to make it more evident that tampering has occurred.

It is to be understood that with the corrugated or scalloped neck finish configuration, the tamper evident band will break quicker and much more reliably than prior arrangements.

At this time it is pointed out that the depth of the grooves 48, 58 will be restricted by the wall thickness of the container in the finish neck region. Further, the corrugating or scalloping reduces the weight of material at the finish neck region, thus making it possible to reduce cost and run at faster speeds.

Although the containers have been illustrated as being formed of plastic, it is to be understood that the invention relates to containers which may be formed of glass, plastic or like material.

Although only a preferred embodiment of the invention has been specifically illustrated and described herein, it is to be understood that minor variations may be made in the corrugated or scalloped configuration without departing from the spirit and scope of the invention as defined by the appended claims.

We claim:

1. A container neck finish including an end sealing surface, closure retaining means, and a tamper band retaining bead spaced axially below said closure retaining means from said end sealing surface, said neck finish having a portion axially below said retaining bead being of a corrugated outline forming means for circumferential tensioned interlocking with a circular inner surface of a closure tamper band to resist rotation of a closure tamper band when a closure is rotated for removal.

2. A container neck finish according to claim 1 wherein said corrugated outline has a maximum diameter less than the diameter of said retaining bead.

3. A container neck finish according to claim 1 wherein said corrugated outline includes diametrically oppositely facing portions.

4. A container neck finish according to claim 1 wherein said corrugated outline includes diametrically oppositely facing portions of a wider circumferential spacing than other portions of said corrugated outline.

5. A container neck finish according to claim 1 wherein said corrugated neck finish portion is tapered and increases in outline towards said retaining bead.

6. A container neck finish including an end sealing surface, closure retaining means, and a tamper band retaining bead spaced axially below said closure retaining means from said end sealing surface, said neck finish having a portion axially below said retaining bead being of a corrugated outline forming means for tensioned interlocking with a circular inner surface of a closure tamper band to resist rotation of a closure tamper band when a closure is rotated for removal, said corrugated outline includes a pair of diametrically oppositely facing principal ribs, and a secondary rib on each side of each of said principal ribs, each of said secondary ribs having a sloping generally flat axial face extending circumferentially generally towards a respective one of said primary ribs.

7. A container neck finish according to claim 6 wherein said corrugated outline also extends between said secondary ribs.

8. A container neck finish and closure combination with said container neck finish including an end sealing surface, closure retaining means, and a tamper band retaining bead spaced axially below said closure retaining means from said end sealing surface, said neck finish having a portion axially below said retaining bead being of a corrugated outline, said closure being carried by said neck finish and including a skirt closed by an end panel, retaining means on said skirt releasably engaging said closure retaining means with said end panel closing said neck finish, and a tamper band depending from said skirt for release from said skirt when said closure is removed from said neck finish, said retaining band being engaged with said corrugated outline portion in a circumferential tensioned state and interlocked relation.

9. A combination according to claim 8 wherein said corrugated outline has a maximum diameter less than the diameter of said retaining bead.

10. A combination according to claim 8 wherein said corrugated outline includes diametrically oppositely facing portions.

11. A combination according to claim 8 wherein said corrugated outline includes diametrically oppositely facing portions of a wider circumferential spacing than other portions of said corrugated outline.

12. A combination according to claim 8 wherein said corrugated neck finish portion is tapered and increases in outline towards said retaining bead.

13. A combination according to claim 8 wherein said corrugated outline includes a pair of diametrically oppositely facing principal ribs, and a secondary rib on each side of each of said principal ribs, each of said secondary ribs having a sloping generally flat face extending circumferentially towards a respective one said primary ribs.

14. A combination according to claim 13 wherein said corrugated outline also extends between said secondary ribs.

* * * * *